US006077121A

United States Patent [19]

Wu

[11] Patent Number: 6,077,121

[45] Date of Patent: Jun. 20, 2000

[54] PLUG CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/324,790

[22] Filed: Jun. 3, 1999

[30] Foreign Application Priority Data

Sep. 8, 1998 [TW] Taiwan ..... 87214841

[51] Int. Cl.[7] ..... H01R 13/648

[52] U.S. Cl. ..... 439/607; 439/74

[58] Field of Search ..... 439/74, 101, 108, 439/607, 677

[56] References Cited

U.S. PATENT DOCUMENTS

| | | | |
|---|---|---|---|
| 5,697,799 | 12/1997 | Consoli et al. | 439/607 |
| 5,746,622 | 5/1998 | Consoli et al. | 439/521 |
| 5,842,874 | 12/1998 | Yagi et al. | 439/74 |
| 5,915,975 | 6/1999 | McGrath | 439/108 |
| 5,921,814 | 7/1999 | Maruyama | 439/607 |

*Primary Examiner*—Renee Luebke
*Assistant Examiner*—T. C. Patel
*Attorney, Agent, or Firm*—Wei Te Chung

[57] ABSTRACT

A plug connector includes an insulative body adapted to be positioned on a circuit board. The body forms at least two spaced terminal support members thereon. Each terminal support member defines terminal receiving channels for retaining contact terminals. Each contact terminal has a board mounting section extending beyond the insulative body for being surface mounted to the circuit board. Each terminal support member further defines a slit for receiving a conductive board electrically engaged with the circuit board. A shielding shell attached to the insulative body defines slots therein for receiving and exposing the terminal support members. The shielding shell is in electrical engagement with the conductive boards and grounded to the circuit board. An opening may be defined in the connector between the terminal support members for accommodating electrical elements of the circuit board.

15 Claims, 6 Drawing Sheets

PLUG CONNECTOR

BACKGROUND OF THE INVENTION

1. Field of the Invention

The present invention generally relates to an electrical connector, and in particular to a plug connector having at least two terminal support plates for supporting and retaining a large number of contact terminals in a limited space.

2. The Prior Arts

The speed and volume of data transmitted between electronic devices have increased remarkably in recent years. The number of contact terminals of a connector connecting the electronic devices together has also increased for facilitating faster data transmission. The trend of recent computer designs emphasizes minimization, thus the space occupied by a connector on a circuit board should be limited. In order to increase the number of contact terminals in a connector having a single terminal support member defining terminal receiving channels therein, the "density" of the terminals is increased, namely, terminal pitch is reduced. The terminal density, however, cannot be increased unlimitedly. Examples of connectors having a single terminal support member are disclosed in Taiwan patent application Nos. 84112993 and 85203116.

It is thus desirable to overcome the disadvantages of the prior art by adding at least one terminal support member to the connector which allows the number of contact terminals arranged in the connector to be doubled with a limited increase in the overall space occupied by the connector.

SUMMARY OF THE INVENTION

Accordingly, an object of the present invention is to provide a plug connector comprising at least two terminal support members each supporting and retaining contact terminals.

Another object of the present invention is to provide a plug connector comprising at least two terminal support members and defining an opening therebetween for accommodating electrical elements.

To achieve the above objects, a plug connector in accordance with the present invention comprises an insulative body adapted to be positioned on a circuit board. The body forms at least two spaced terminal support members thereon. Each terminal support member defines terminal receiving channels for retaining contact terminals. Each contact terminal has a board mounting section extending beyond the insulative body for being surface mounted to the circuit board. Each terminal support member further defines a slit for receiving a conductive board electrically engaged with the circuit board. A shielding shell attached to the insulative body defines slots for receiving and exposing the terminal support members. The shell has rivet fasteners mounted thereto for extending into and engaging with holes defined in the insulative body thereby securing the shell to the body. The shielding shell is in electrical engagement with the conductive boards and grounded to the circuit board. Guide posts are provided on the shielding shell for guiding the mating operation between the plug connector and a mating socket connector. An opening may be defined in the connector between the terminal support members for accommodating electrical elements of the circuit board.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
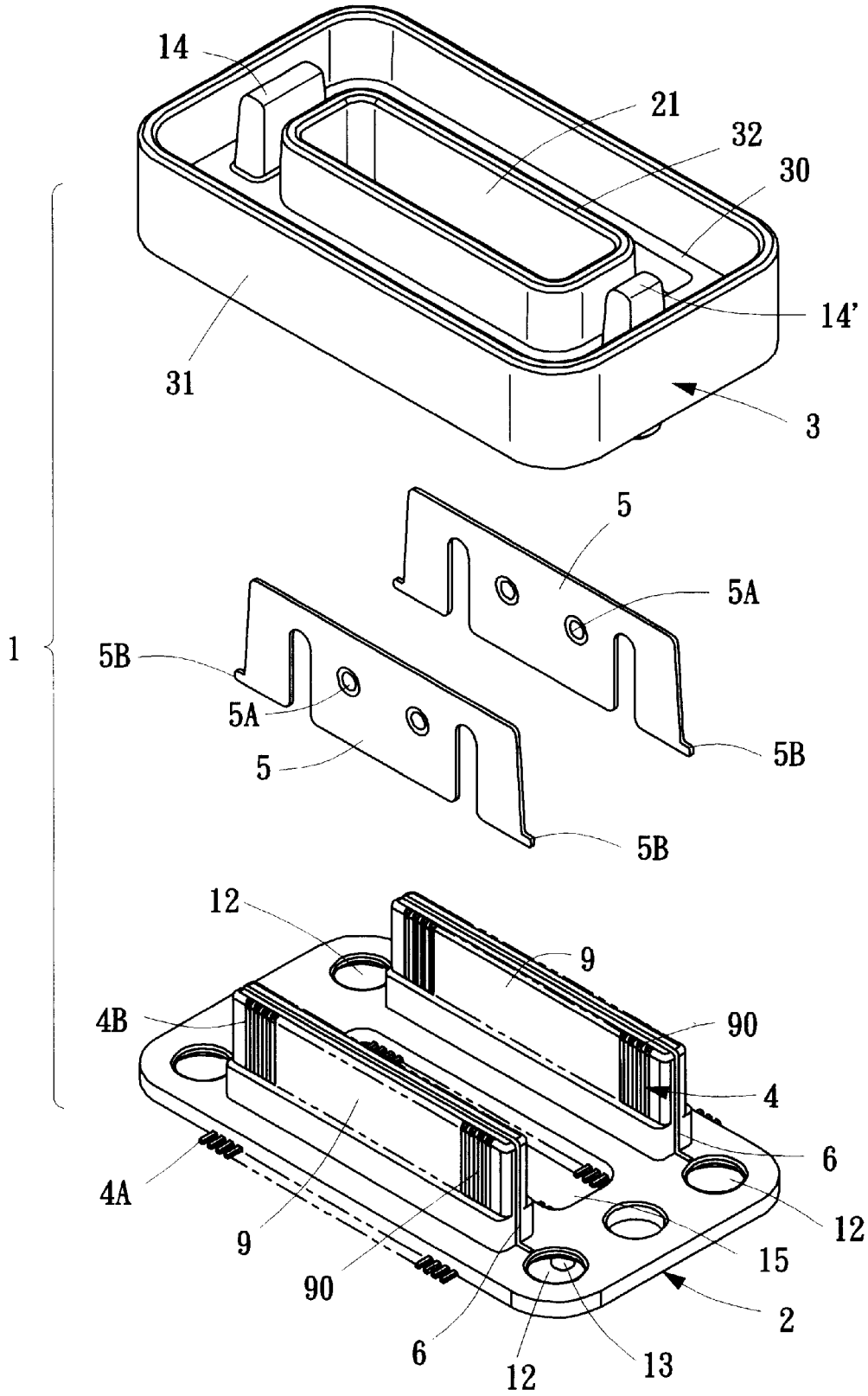
FIG. 1 is an exploded view of a plug connector constructed in accordance with a first embodiment of the present invention.
Figure 2:
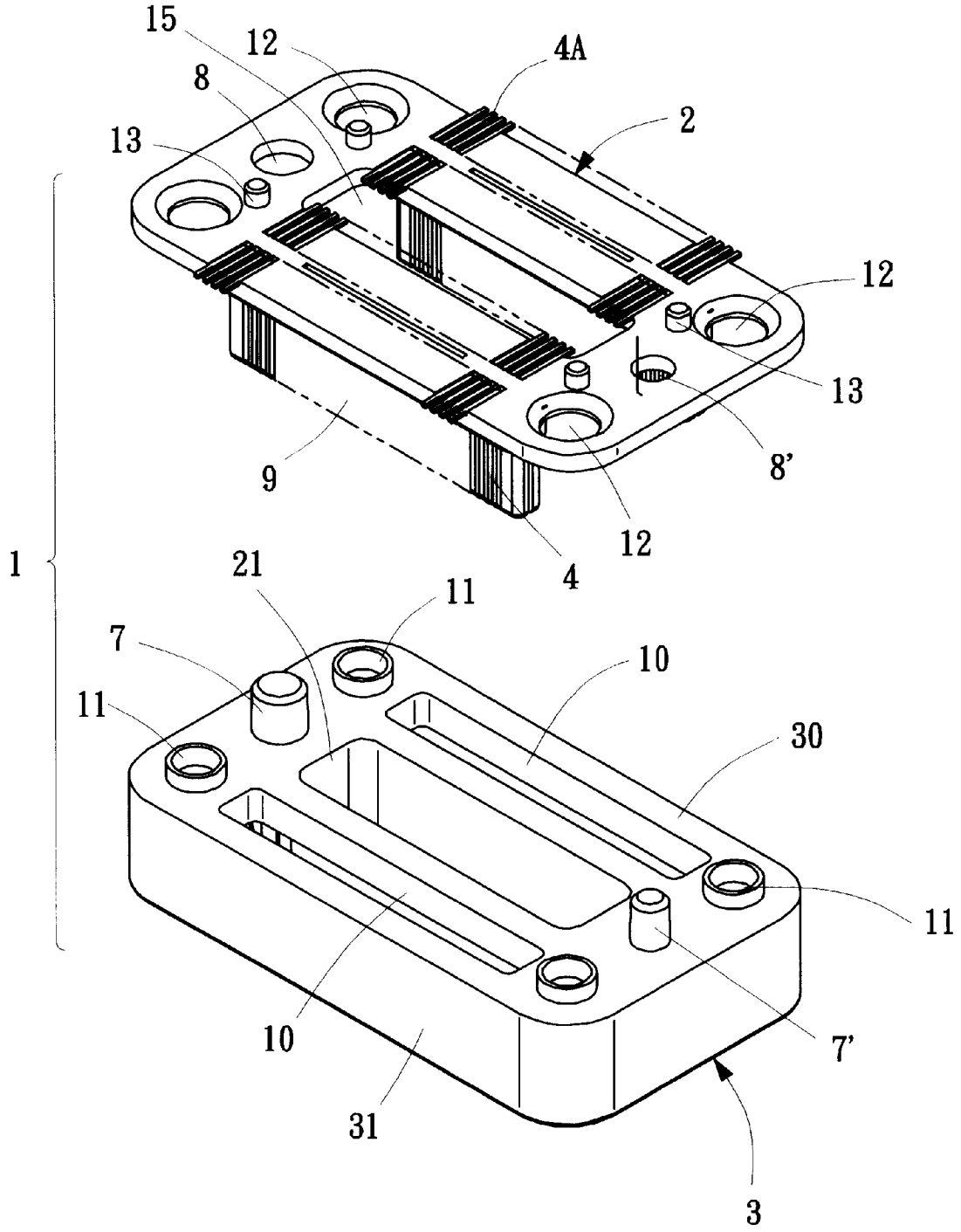
FIG. 2 is a view similar to FIG. 1 observed from a different direction with conductive blades received in slits of an insulative body of the connector.
Figure 3:
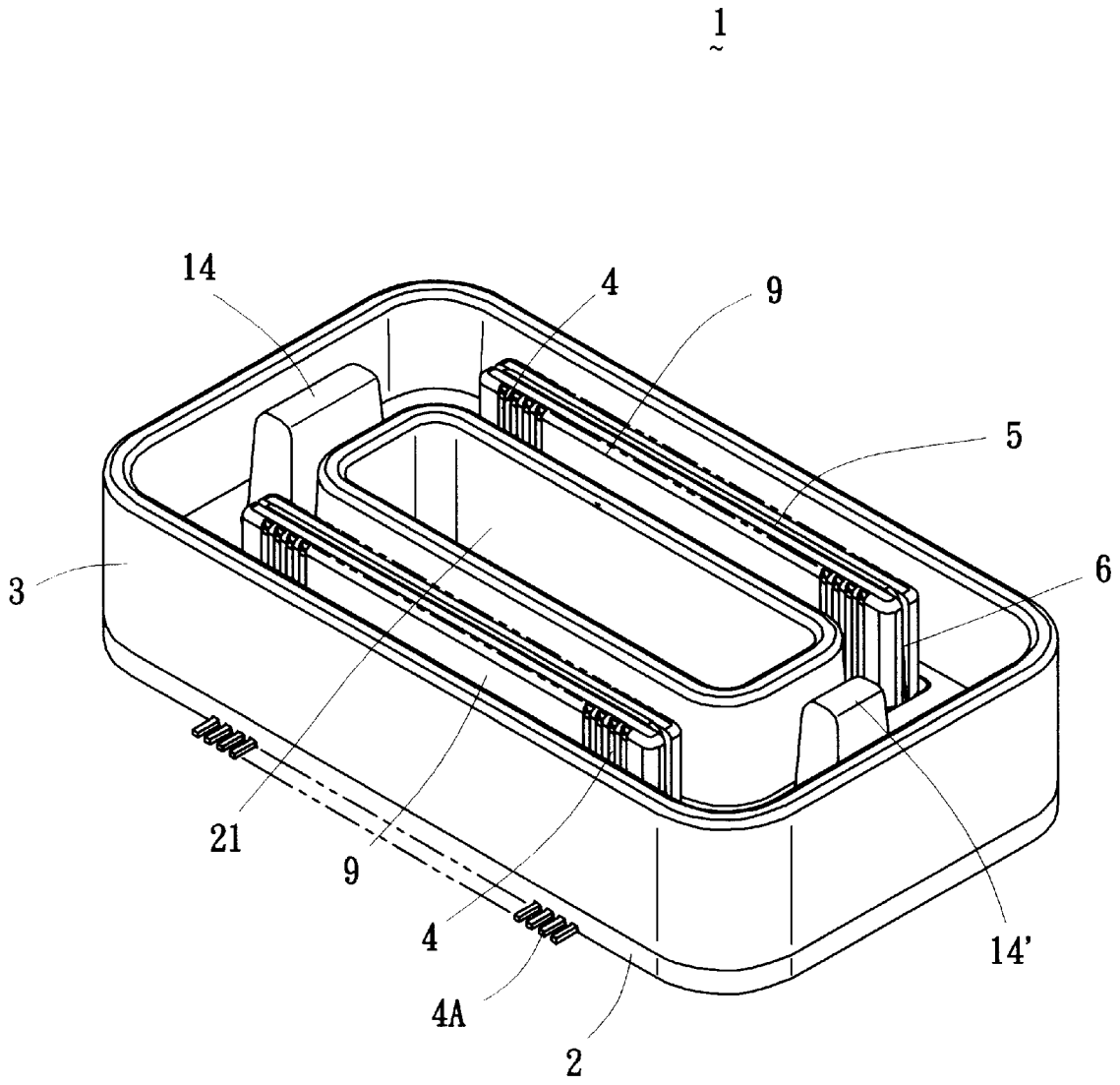
FIG. 3 is an assembled view of FIG. 1.

Referring to the drawings and in particular to FIGS. 1–3, wherein a plug connector constructed in accordance with the present invention, generally designated by reference numeral 1, is shown, the connector 1 comprises an insulative body 2 adapted to be positioned on a circuit board (not shown). The insulative body 2 comprises two terminal support members 9 formed thereon at locations proximate edges thereof. Each terminal support member 9 defines a plurality of terminal receiving channels 90 on opposite faces thereof for receiving and retaining terminal contacts 4 therein. A shielding shell 3 has a base 30 defining two slots 10 therein and an outer circumferential wall 31 extending from the base 30. The shell 3 is attached to the insulative body 2 by inserting and retaining the terminal support plates 9 in the corresponding slots 10.

Each contact terminal 4 has a mating section 4B received in the corresponding terminal receiving channel 90 and a board mounting section 4A extending beyond a bottom face of the insulative body 2 for being surface mounted to the circuit board. The bottom face of the insulative body 2 is provided with positioning pins 13 for properly positioning the connector 1 on the circuit board.

A slit 6 is disposed in each terminal support member 9 for receiving a conductive blade 5 therein. Each blade 5 comprises a plurality of embossments 5A for providing a snug fit within the corresponding slit 6 and two opposite side extensions 5B for electrically engaging with the base 30 of the shielding shell 3 for providing a grounding path between the shielding shell 3 and the circuit board.

Two guide pins 7, 7' are formed on the base 30 for being respectively received in holes 8, 8' defined in the insulative body 2. Preferably, the pins 7, 7' are configured differently for preventing incorrect orientation when attaching the shielding shell 3 to the insulative body 2. The shielding shell 3 forms rivet fasteners 11 on the base 30. The fasteners 11 are received in and engage with holes 12 defined in the insulative body 2 for securing the shielding shell 3 to the insulative body 2.

The shielding shell 3 is provided with guide posts 14, 14' on a top face of the base 30 for being received in corresponding bores of a mating socket connector (not shown) to guide the mating operation thereof. Preferably, the guide posts 14, 14' are configured differently for preventing incorrect orientation during mating.

An opening 15 is defined in the insulative body 2 between the two terminal support members 9, and the base 30 of the shielding shell 3 defines a cavity 21 corresponding in position to the opening 15. Preferably, the cavity 21 is surrounded by an inner circumferential wall 32 for separating the two terminal support members 9 from each other. If desired, the opening 15 and the cavity 21 can accommodate electrical elements (not shown) of the circuit board.

Figure 4:
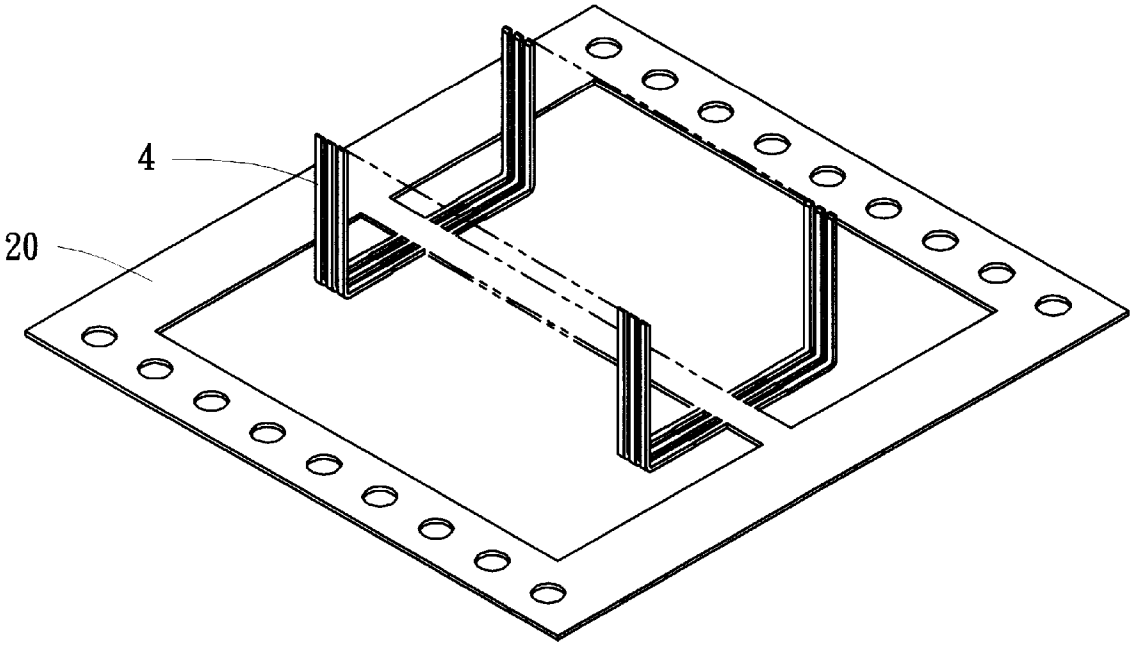
FIG. 4 is a perspective view of a metal blank for forming contact terminals.
Figure 5:
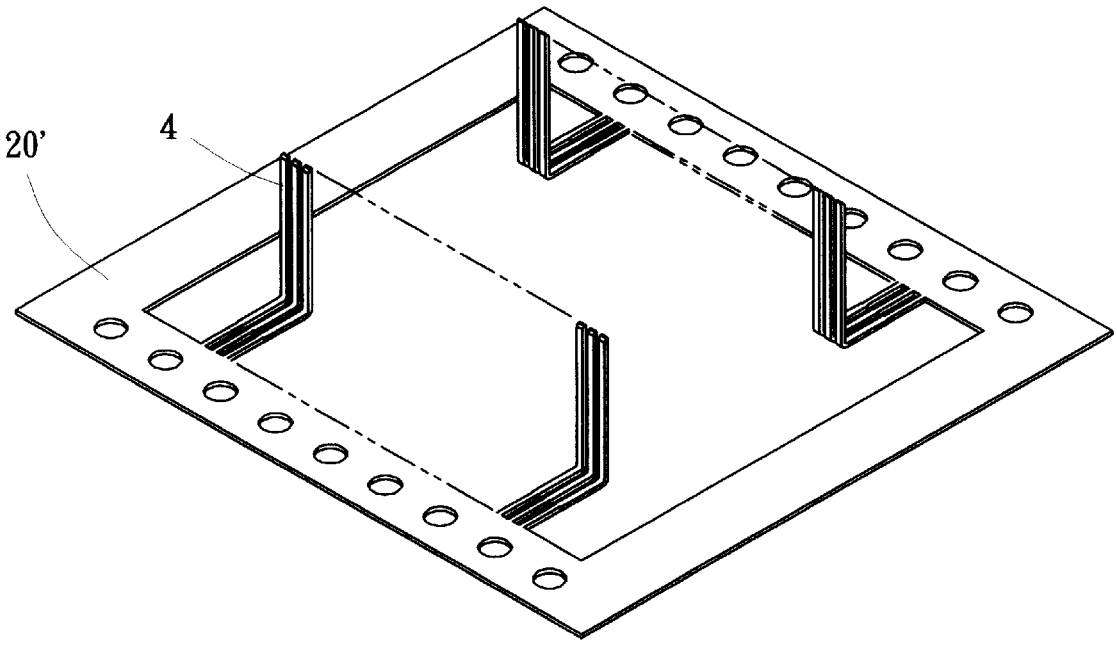
FIG. 5 is a perspective view of another metal blank for forming the contact terminals.

FIGS. 4 and 5 show metal blanks 20, 20' for forming the contact terminals 4. The contact terminals 4 are formed in pairs on each of the metal blanks 20, 20' for enhancing the efficiency of mounting the contact terminals 4 to the insulative body 2. Under this situation, the first metal blank 20 defines two small openings divided by a central bar with pairs of terminals 4 extending therefrom in opposite directions for being respectively assembled to the inner sides of those two terminal support members 9, while the second metal blank 20' defines a large opening with pairs of terminals 4 extending from two far spaced opposite edges thereof for being respectively assembled to the outer sides of the two terminal support members 9.

Figure 6:
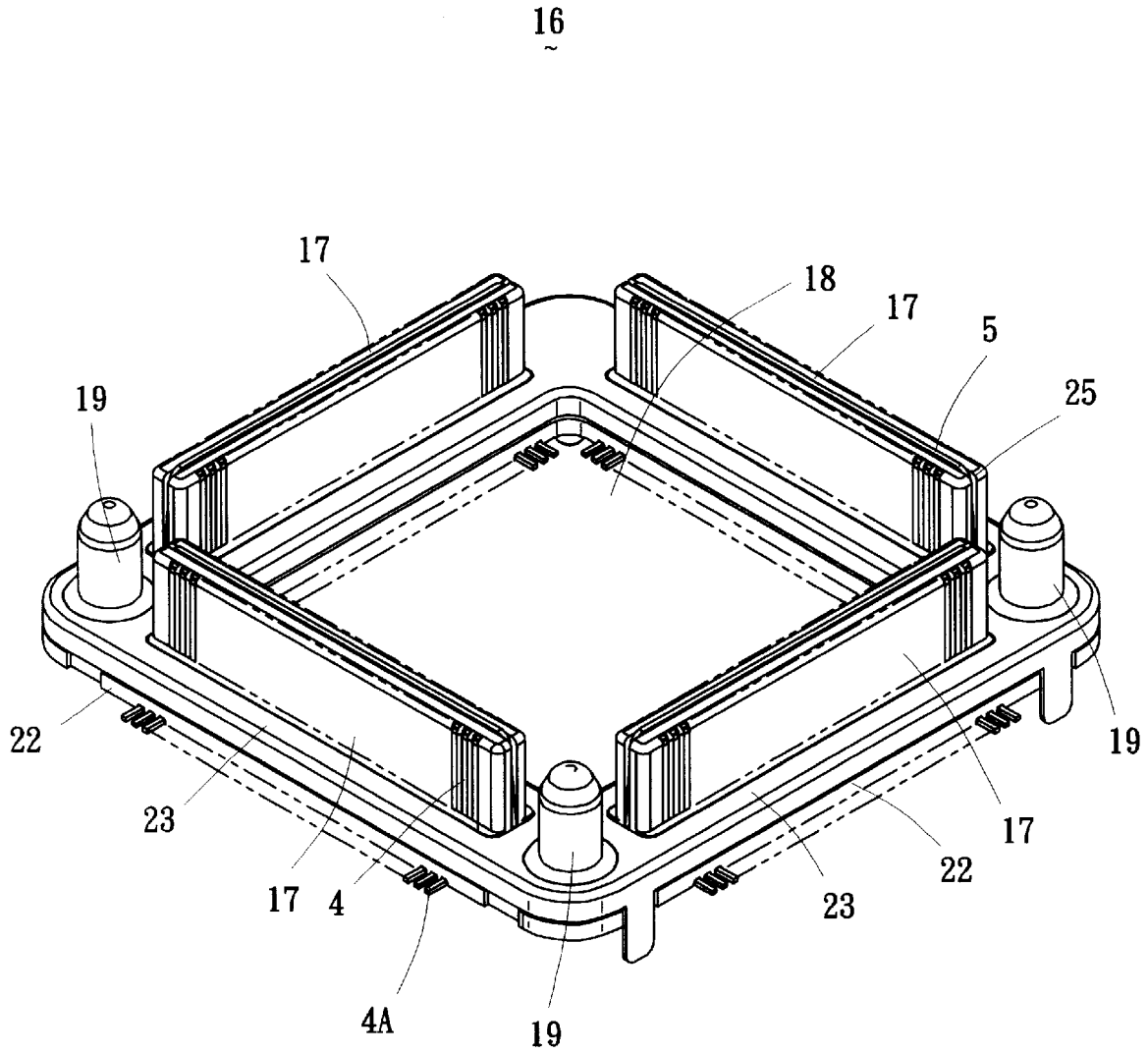
FIG. 6 is a perspective view of a plug connector in accordance with a second embodiment of the present invention.

FIG. 6 shows a second embodiment of the plug connector in accordance with the present invention. The plug connector of the second embodiment, designated by reference numeral 16, comprises an insulative body 22 having four terminal support members 17 formed hereon at locations proximate four edges thereof, thereby forming a quadrilateral configuration having four comers. Each terminal support member 17 defines terminal receiving channels on opposite faces thereof for retaining contact terminals 4 therein. The board mounting section 4A of each contact terminal 4 extends beyond a bottom face of the insulative body 22 for being surface mounted to a circuit board (not shown).

A shielding shell 23 is attached to the insulative body 22 and exposes the contact terminals 4. Guide posts 19 are provided on three of the four comers of the quadrilateral configuration of the shielding shell 23 for guiding the mating operation of the connector 16 with a mating socket connector (not shown). Each terminal support member 17 defines a slit 25 for receiving a conductive board 5 that provides a grounding path between the shielding shell 23 and the circuit board. An opening 18 is defined in the connector 16 between the terminal support members 17 for accommodating electrical elements of the circuit board.

Although the present invention has been described with reference to preferred embodiments thereof, it is apparent to those skilled in the art that a variety of modifications and changes that may be made without departing from the scope of the present invention which is intended to be defined by the appended claims.

What is claimed is:

1. An electrical connector adapted to be mounted to a substrate for selectively mating with a mating connector, the electrical connector comprising:

an insulative body adapted to be fixed to the substrate, comprising at least two terminal support members extending therefrom, each terminal support member defining a plurality of terminal receiving channels;

a plurality of contact terminals received in the corresponding terminal receiving channels, the contact terminals having a board mounting section extending beyond the insulative body for mounting to the substrate; and a shielding shell attached to the insulative body, the shielding shell defining slots therein for receiving and exposing the corresponding terminal support members.

2. The electrical connector as claimed in claim 1, wherein the insulative body comprises edges, the terminal support members being respectively formed proximate the edges.

3. The electrical connector as claimed in claim 2, wherein the shielding shell comprises guide posts for inserting into corresponding bores defined in the mating connector to guide the mating of the electrical connector with the mating connector.

4. The electrical connector as claimed in claim 3, wherein the guide posts are configured differently.

5. The electrical connector as claimed in claim 1, wherein the insulative body defines an opening between the terminal support members.

6. The electrical connector as claimed in claim 1, wherein each terminal support member has a conductive member arranged between the shielding shell and the insulative body, the conductive member electrically grounding the shielding shell to the substrate.

7. The electrical connector as claimed in claim 6, wherein the terminal support member defines a slit for receiving the conductive member.

8. The electrical connector as claimed in claim 7, wherein the conductive member comprises embossments for snugly fitting within the slit.

9. The electrical connector as claimed in claim 1, wherein the shielding shell forms pins thereon, and wherein the insulative body defines holes therein for receiving the pins of the shielding shell.

10. The electrical connector as claimed in claim 9, wherein the pins are configured differently, and wherein the holes are dimensioned to correspond with the pins.

11. The electrical connector as claimed in claim 1, wherein the shielding shell comprises fasteners mounted thereon for engaging with holes defined in the insulative body thereby securing the shielding shell to the insulative body.

12. The electrical connector as claimed in claim 1, wherein the insulative body comprises positioning pins formed thereon for inserting into bores defined in the substrate for properly positioning the connector on the substrate.

13. The electrical connector as claimed in claim 2, wherein the insulative body comprises two terminal support members proximate opposite edges of the insulative body, respectively.

14. The electrical connector as claimed in claim 2, wherein the insulative body comprises four terminal support members proximate four edges of the insulative body, respectively.

15. The electrical connector as claimed in claim 14, wherein the four edges of the insulative body define four comers, three of the comers having guide posts formed thereon.

* * * * *